US005236247A

United States Patent [19]

Hewko

[11] Patent Number: 5,236,247

[45] Date of Patent: Aug. 17, 1993

[54] INSERT MOLDED COMPOSITE PLASTIC SEAT CUSHION FRAME

[75] Inventor: Marc D. Hewko, Canton, Mich.

[73] Assignee: Hoover Universal, Inc., Plymouth, Mich.

[21] Appl. No.: 835,410

[22] Filed: Feb. 14, 1992

[51] Int. Cl.[5] ..... A47C 7/02

[52] U.S. Cl. ..... 297/452.1; 297/DIG. 2

[58] Field of Search ..... 297/452, DIG. 2

[56] References Cited

U.S. PATENT DOCUMENTS 3,084,980 4/1963 Lawson .
3,127,220 3/1964 Stine .
3,289,224 12/1966 Witchel .
3,310,300 3/1967 Lawson .
3,904,243 9/1975 Kostelec et al. ..... 297/DIG. 2 X
4,332,419 6/1982 Vogel ..... 297/452 X
4,418,958 12/1983 Watkin ..... 297/DIG. 2 X
4,781,417 11/1988 Shipman et al. ..... 297/452 X
4,793,607 12/1988 Suellentrop .
5,048,894 9/1991 Miyajima et al. ..... 297/452 X

*Primary Examiner*—Philip C. Kannan
*Attorney, Agent, or Firm*—Harness, Dickey & Pierce

[57] ABSTRACT

A seat cushion frame for a vehicle seat assembly which is comprised of a metal reinforcing sheet insert molded into a plastic resin. By insert molding a reinforcing material into a low weight and strength plastic resin, a strength comparable to a high strength engineered plastic resin seat cushion frame and a stamped steel seat cushion frame can be achieved. However, the insert molded composite has the weight reduction advantages of the high strength engineered resin seat cushion frame at a cost comparable to a stamp steel seat cushion frame.

19 Claims, 3 Drawing Sheets

INSERT MOLDED COMPOSITE PLASTIC SEAT CUSHION FRAME

BACKGROUND AND SUMMARY OF THE INVENTION

The present invention relates to a seat cushion frame for supporting the seat cushion in a vehicle seat assembly and in particular to a seat cushion frame made of a composite plastic insert molded with a metal reinforcing material.

The seat cushion frame of vehicle seat assemblies have typically been produced from a stamped steel sheet. A stamped steel cushion frame can be made relatively inexpensive however, a stamped steel cushion frame is relatively heavy. To reduce the weight of a seat cushion frame, it is possible to injection mold a cushion frame using a high strength engineered plastic resin such as Valox HS433 or Nydur BKV 130. Cushion frames can be made with such high strength engineered plastic resins with a weight savings of approximately 30% compared to the stamped steel cushion frame. However, the weight savings comes at a substantial cost penalty. The weight savings is not significant enough to justify the additional cost.

Lower cost and lower weight plastic resins such as polypropolene and polyethylene terephthalate can be used providing a substantial weight savings compared to both the stamped steel cushion frames and the high strength plastic resin cushion frames and also at a lower cost. However, the strength of a cushion frame made solely of these lower weight and lower cost resins is not adequate.

Accordingly, it is an object of the present invention to provide a seat cushion frame of low cost and low weight plastic resin that is reinforced to provide the necessary strength to the cushion frame.

It is an advantage of the present invention that the reinforced plastic seat cushion frame can be made with a substantial weight savings compared to a stamped steel frame at only a slight increase in cost.

It is a further advantage of the present invention that the reinforced plastic seat cushion frame can be made with a weight savings compared to a high strength plastic resin seat cushion frame and at significantly lower cost.

The seat cushion frame of the present invention is made by insert molding a metal reinforcing material with the low cost low weight plastic resin to reinforce the plastic resin to prevent brittle fracture during high loading. By insert molding either expanded metal or wire cloth in the areas of high stress in the cushion frame, the tendency of the plastic to fracture in a brittle manner is greatly reduced. The metal reinforcing material in the areas of high loading utilizes the ductility of the metal to prevent the sudden fracture of the plastic.

The reinforcement material can be placed throughout the seat cushion frame or can be limited to those regions of the cushion frame that experience high loading. The reinforcing material used can be either an expanded metal or a wire cloth both of which have a multiplicity of interstices that are filled with the plastic resin when the resin is molded around the reinforcing material.

Further objects, features and advantages of the invention will become apparent from a consideration of the following description and the appended claims when taken in connection with the accompanying drawings.

DETAILED DESCRIPTION OF THE INVENTION

Figures 1, 2:
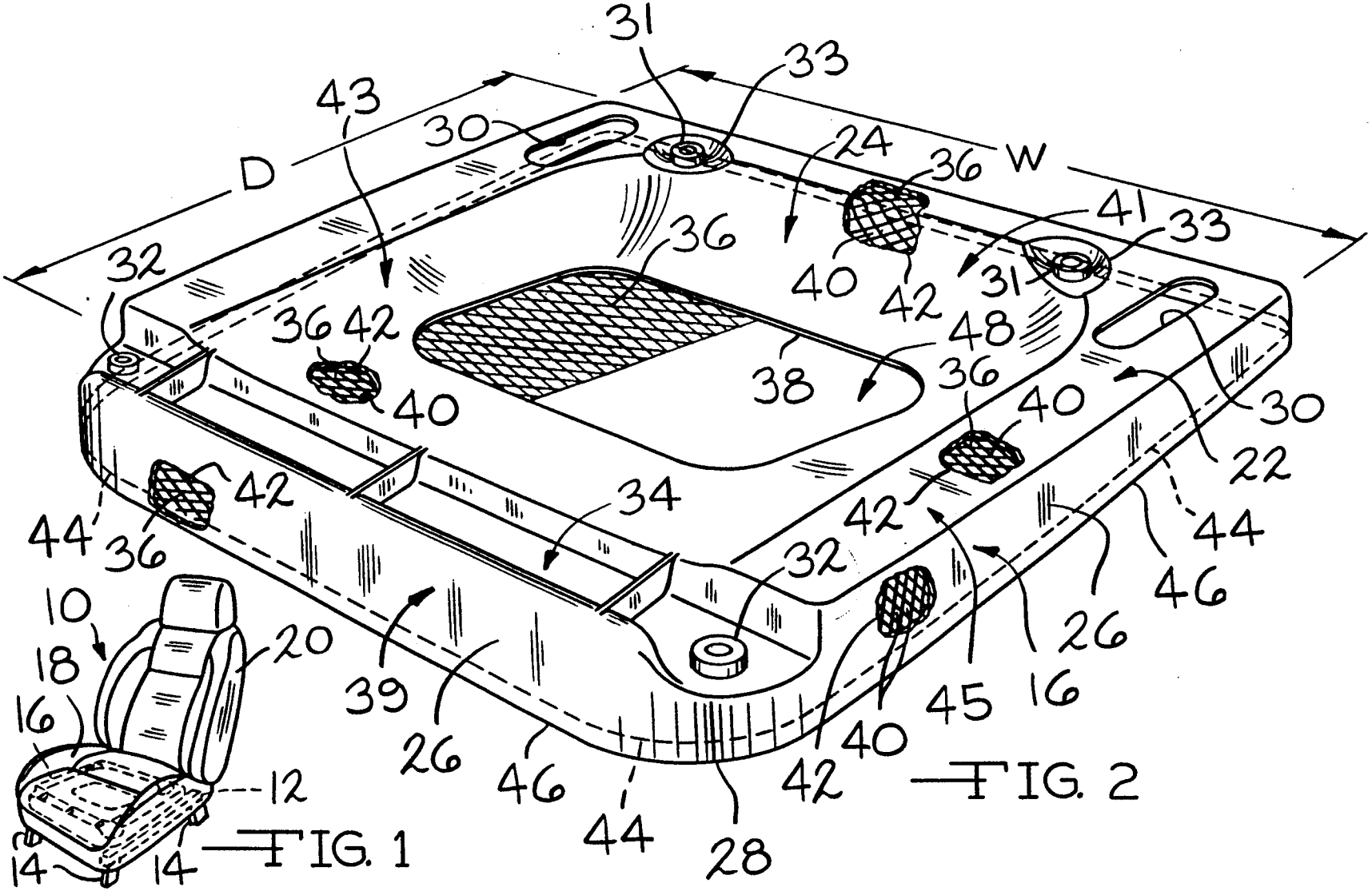
FIG. 1 is a perspective view of a seat assembly showing the seat cushion frame of the present invention therein.
FIG. 2 is a perspective view of one embodiment of the seat cushion frame of the present invention with portions broken away to illustrate the reinforcing material within the plastic resin.

The seat cushion frame of the present invention is contained in the seat assembly 10 shown in FIG. 1. The seat assembly 10 includes a seat frame 12 upon which the seat assembly is supported. The frame 12 includes a number of legs 14 for attaching the seat assembly to a motor vehicle. A seat frame 12 typically includes a fore and aft adjuster mechanism (not shown). The seat cushion frame 16 of the present invention is attached to and carried by the seat frame 12. The seat cushion frame 16 carries an upholstered foam pad seat cushion 18 upon which an occupant of the seat assembly 10 is seated. Extending upwardly at the rear of the seat cushion is a seat back 20.

A seat cushion frame 16 is shown enlarged in FIG. 2 and is generally two-dimensional in its extent having a width W which extends laterally relative to the seat assembly and a depth D that extends in a fore and aft direction relative to the seat assembly thus forming a generally rectangularly shaped seat cushion frame. The top wall 22 of the seat cushion frame 16 includes a large shallow recessed portion 24 contoured for seating comfort. Surrounding the top wall 22 is a generally downwardly depending skirt 26 leading to the peripheral edge 28 of the seat cushion frame.

Slotted openings 30 are formed in the top wall 22 near the two rear corners. These slots provide access for legs of a seat back frame to pass through the cushion frame to a seat track below the cushion frame. Adjacent to slots 30 are rear mounting bosses 31 disposed in depressions 33 to avoid an upward projection from the top of the seat cushion frame. Likewise, mounting bosses 32 are formed near the front two corners of the seat cushion frame. The front mounting bosses 32 are located in a laterally extending recessed trough 34 to lower the mounting bosses from the top wall 22. This avoids a structure protruding upwardly from the seat cushion frame at a location directly supporting an occupant which would be detected by the occupant. The laterally extending recessed trough 34 also enables the front portion of the seat cushion 18 to be thicker along the front edge of the seat assembly providing added comfort for a seat occupant. At the front edge of the seat assembly supporting a seat occupant's thighs.

The seat cushion 18 is placed on top of the seat cushion frame 16 with the upholstery cover being wrapped around and underneath the cushion frame where it is held in place by fasteners (not shown) in a conventional manner. The seat cushion frame shown in FIG. 2 is comprised of a metal sheet reinforcing material 36 insert molded within a plastic resin 38. In the embodiment shown in FIG. 2, the metal sheet material 36 extends generally throughout the seat cushion frame 16. The metal sheet material is first stamped to a predetermined shape and then placed within a mold in which the plastic resin 38 is molded around the metal sheet material 36. The metal sheet 36 is positioned in the plastic mold in such a manner than the metal sheet is spaced from the surfaces of the mold so that the plastic resin is allowed to completely surround and encapsulate the metal sheet. The metal sheet can either be an expanded metal or a woven wire cloth forming a plurality of interstices 40 in the metal sheet that are filled with the plastic resin during molding. For illustration purposes only, the plastic resin has been removed at several openings 42 to illustrate the metal sheet 36 within the plastic resin.

In the embodiment shown in FIG. 2, the metal sheet 36 extends generally throughout the seat cushion frame 16. The outer edge 44 of the metal sheet however, is spaced inward slightly from the peripheral edge 46 of the plastic resin so as to ensure that the edge of the metal sheet 44 is imbedded within the resin and thereby concealed, making it easier to handle the seat cushion frame without injury from exposed sharp metal edges. A variety of low cost and low weight plastic resins can be used, seat cushion frames with polypropolene, both with and without glass fibers, polyethylene terephthalate with 20% glass fibers, and a polypropelene and PET blend have been used to make prototype seat cushion frames that have performed satisfactorily during impact loading tests.

The seat cushion frame 16 is generally formed by spaced front and rear portions 39, 41 and spaced left and right side portions 43, 45 respectively forming a large central opening 48 extending fore and aft between the front and rear portions 39, 41 and extending laterally between the left and right side portions 43, 45. By forming the seat cushion frame with opening 48, the quantity of plastic resin required in the seat cushion frame 16 is reduced. The metal sheet 36 can extend across the opening as shown on the left hand side of the opening in FIG. 2, or the metal sheet can be removed from the opening 48 as shown on the right hand side of the opening in FIG. 2. The width of the opening 48 is between approximately one quarter and one half of the overall width W of the seat cushion frame. The depth of the opening 48 is between approximately one quarter to one half of the depth D of the seat cushion frame. The seat cushion frame can be made with or without the central opening 48. When made with a central opening 48, a spring wire seat cushion suspension (not shown) may be used, spanning across the opening in a well known manner.

Figure 3:
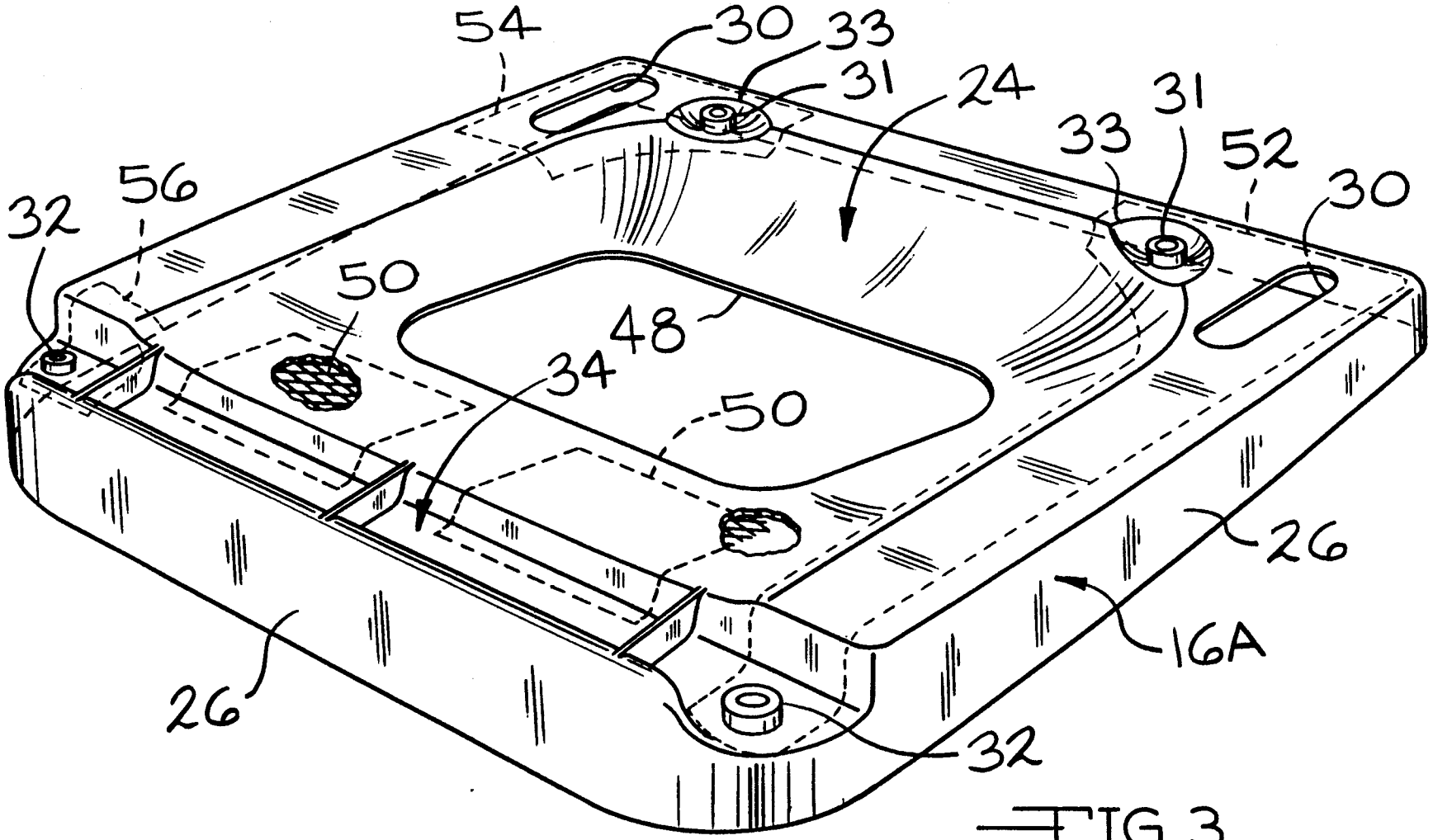
FIG. 3 is a perspective view similar to FIG. 2 illustrating an alternative embodiment of the present invention.

An alternative embodiment of the seat cushion frame of the present invention is shown in FIG. 3 and designated as 16A. In seat cushion frame 16A, the metal sheet is only inserted into the seat cushion frame in certain highly loaded portions rather than being positioned throughout the seat cushion frame. Two metal sheet panels 50 are positioned toward the forward edge of the recess 24, forward of the central opening 48. This location, at the forward edge of the recess 24, experiences high loading from a seat occupant during a frontal impact vehicle collision. By placing the metal sheet sections in this location, the likelihood of brittle fracture of the plastic resin due to high loading can be reduced or limited.

Another metal sheet panel 52 is shown reinforcing both the area surrounding the rear mounting boss 31 and also the area surrounding the front mounting boss 32. The metal sheet panel 52 thus reinforces the seat cushion frame in the area of attaching points which also experience high loading during a vehicle collision. The metal sheet panel 52 connects the forward mounting boss 32 with the rear mounting boss 31 along the side of the seat assembly. During a vehicle collision, when the front portion of the seat cushion frame experiences loading, a portion of this loading is transferred by the metal sheet panel 52 to the rear of the seat cushion frame and the mounting at boss 31.

Alternatively, as shown on the left hand side of the seat cushion frame 16A, a separate metal sheet panel 54 is placed around the left rear mounting boss 31 and a separate metal sheet panel 56 is placed around the forward mounting boss 32. The metal sheet panels 50, 52, 54 and 56 are shown to illustrate various ways to provide local reinforcement. Any combination of separate panels can be used to provide the desired resistance to brittle fracture.

Figure 4:
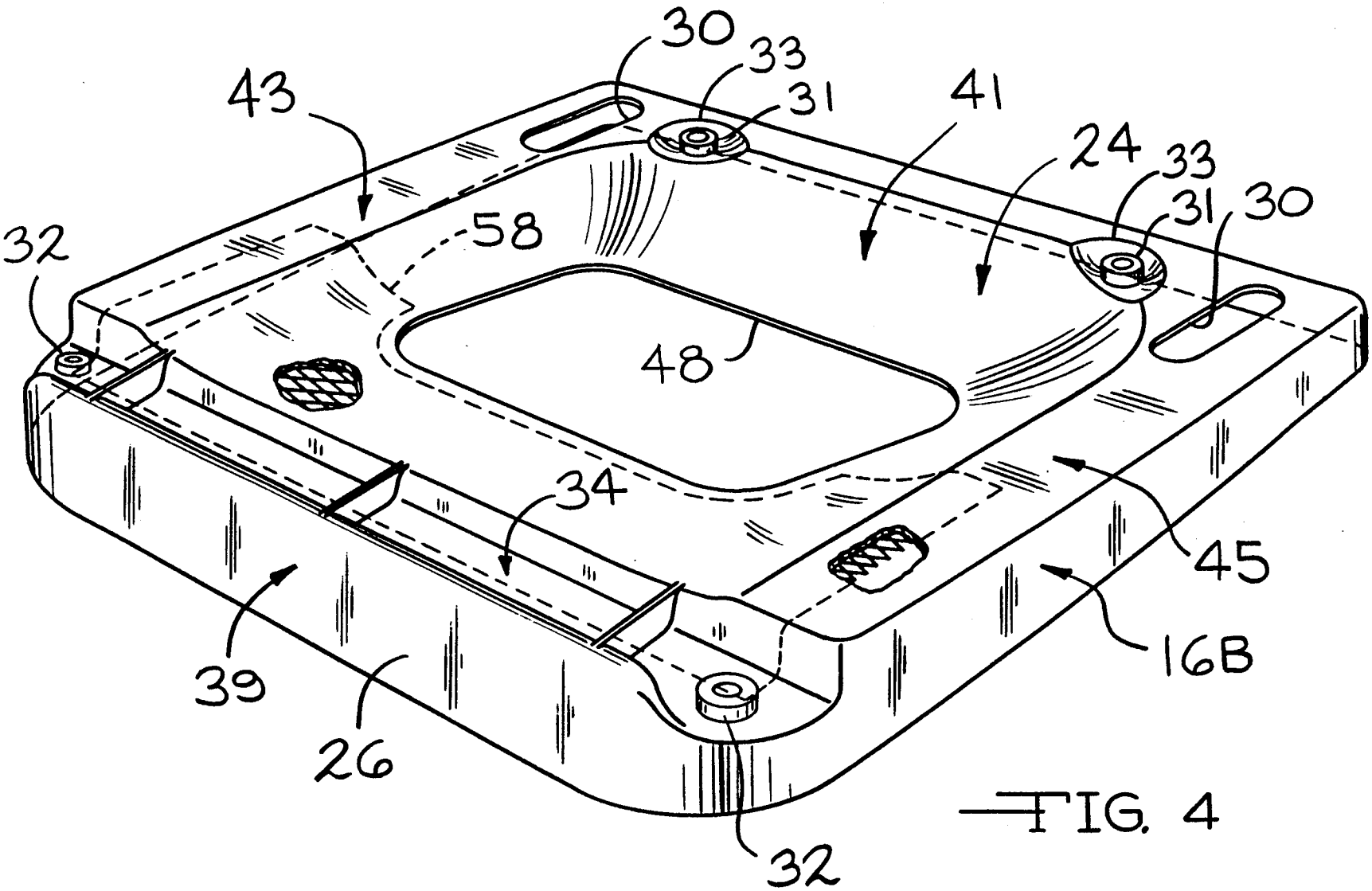
FIG. 4 is a perspective view of the seat cushion frame of the present invention illustrating another embodiment of the invention.

Another embodiment of the seat cushion frame is shown in FIG. 4 and designated as 16B. In this embodiment, the front portion 39 of the seat cushion frame and the front sections of the two side portions 43, 45 are reinforced by a metal sheet 58 which extends over substantially the forward portion of the seat cushion frame 16B, the area experiencing high loads during a frontal vehicle collision.

The seat cushion frame of the present invention comprised of a metal sheet insert molded into a plastic resin has been found to achieve a weight reduction compared to a stamped steel seat cushion frame as much as 45%. The seat cushion frame of the present invention thus achieves the objective of providing a lower weight seat cushion frame with only a marginal impact on the seat cushion frame cost.

It is to be understood that the invention is not limited to the exact construction illustrated and described above, but that various changes and modifications may be made without departing from the spirit and scope of the invention as defined in the following claims.

I claim:

1. A seat assembly for an automotive vehicle comprising:

a seat frame;

a seat cushion frame attached to and carried by said seat frame; and a seat cushion supported by said seat cushion frame;

said seat cushion frame including a formed panel of molded plastic resin of generally two dimensional extent and a shaped metal sheet having a multiplicity of interstices molded within said plastic resin whereby said plastic resin surrounds said shaped metal sheet and is molded into said interstices to stiffen said metal sheet.

2. The seat assembly of claim 1 wherein said seat cushion frame includes a top wall and a generally downwardly extending skirt about the periphery of said top wall and said metal sheet extends substantially throughout said top wall and skirt, said metal sheet having a peripheral edge imbedded within said molded plastic and spaced inwardly from the edge of said skirt.

3. The seat assembly of claim 1 wherein said metal sheet extends substantially throughout said molded plastic formed panel.

4. The seat assembly of claim 1 wherein said metal sheet is limited to approximately a forward half of said molded plastic formed panel.

5. The seat assembly of claim 1 wherein said seat cushion frame includes a plurality of mounting bosses for attaching said seat cushion frame to said seat frame and said metal sheet comprises a plurality of separate metal sheet panels within said molded plastic with one panel surrounding each of said mounting bosses.

6. The seat assembly of claim 1 wherein said seat cushion frame has a pair of forwardly located mounting bosses and a pair of rearwardly located mounting bosses with one of said rearwardly located mounting bosses spaced rearward of one of said forwardly located mounting bosses and said metal sheet comprising a pair of metal sheet panels with each panel extending fore and aft in said molded plastic formed panel from one of said forwardly located mounting bosses to one of said rearwardly located mounting bosses and surrounding said mounting bosses.

7. The seat assembly of claim 1 wherein said metal sheet is expanded metal.

8. A seat assembly for an automotive vehicle comprising:

a seat frame;

a seat cushion frame attached to and carried by said seat frame; and a seat cushion supported by said seat cushion frame;

said seat cushion frame being a formed panel of generally two dimensional extent having a fore and aft depth dimension and a lateral width dimension, said seat cushion frame being formed of front and rear spaced portions and left and right spaced side portions creating a central opening having a width and depth of approximately one quarter to one half of the width and depth dimensions respectively of said seat cushion frame;

said seat cushion frame being made of a molded plastic resin with at least one metal sheet therein having a multiplicity of intersticies into which said plastic resin is molded.

9. The seat assembly of claim 8 wherein said metal sheet extends across said central opening.

10. The seat assembly of claim 8 wherein said metal sheet extends through said front portion and a forward section of said side portions.

11. The seat assembly of claim 8 wherein said formed panel is of generally rectangular shape and includes a mounting boss at each corner of said formed panel and said metal sheet comprises four separate metal sheet panels of limited extent surrounding each of said mounting bosses.

12. The seat assembly of claim 8 wherein said formed panel is of generally rectangular shape and includes a mounting boss at each corner of said formed panel and said metal sheet comprises two separate metal sheet panels, each said panel surrounding one of said mounting bosses at a front corner of said formed panel and extending rearward to and surround one of said mounting bosses at a rear corner of said formed panel.

13. The seat assembly of claim 8 wherein said spaced front and rear portions and said spaced left and right side portions cooperatively form a top wall and a downwardly depending skirt at the periphery of said top wall, said top wall being generally rectangular in shape and including a pair of front mounting bosses at forward corners of said top wall, said front mounting bosses being in a recessed portion of said top wall.

14. The seat assembly of claim 13 wherein said recessed portion of said top wall extends laterally across said top wall adjacent a front edge of said top wall.

15. The seat assembly of claim 8 wherein said metal sheet is expanded metal.

16. The seat assembly of claim 8 wherein said plastic resin includes polypropolene.

17. The seat assembly of claim 8 wherein said plastic resin includes polyethylene terephthalate.

18. A seat assembly for an automotive vehicle comprising:

a seat frame;

a seat cushion frame attached to and carried by said seat frame; and a seat cushion supported by said seat cushion frame;

said seat cushion frame being a formed panel of generally two dimensional extent having a fore and aft depth dimension and a lateral width dimension, said seat cushion frame being formed of front and rear spaced relationship and left and right spaced side portions creating a generally rectangular top wall with a central opening having a width and depth of approximately one quarter to one half of the width and depth dimensions respectively of said seat cushion frame and with a downwardly depending skirt at the periphery of said top wall;

said seat cushion frame being made of a molded plastic resin with at least one metal sheet therein having a multiplicity of intersticies into which said plastic resin is molded;

a pair of front mounting bosses at forward corners of said top wall, said front mounting bosses being in a recessed portion of said top wall, said recess portion extending laterally across said top wall adjacent a front edge of said top wall.

19. The seat assembly of claim 18 wherein said metal sheet is expanded metal.

* * * * *

UNITED STATES PATENT AND TRADEMARK OFFICE

CERTIFICATE OF CORRECTION

PATENT NO. : 5,236,247

DATED : August 17, 1993

INVENTOR(S) : Marc D. Hewko

It is certified that error appears in the above-indentified patent and that said Letters Patent is hereby corrected as shown below:

Column 6, line 34, claim 18, after spaced, delete "relationship" and insert --portions--

Signed and Sealed this

Third Day of May, 1994

Bruce Lehman

*Attest:*

BRUCE LEHMAN

*Attesting Officer*

*Commissioner of Patents and Trademarks*